US007597545B2

(12) United States Patent
Pedersen et al.

(10) Patent No.: US 7,597,545 B2
(45) Date of Patent: Oct. 6, 2009

(54) AMPLIFIER ASSEMBLY

(75) Inventors: Harry Emil Pedersen, Nordborg (DK); Thorkil Brix Pedersen, Nordborg (DK)

(73) Assignee: Hartho-Hydraulic ApS, Nordborg (DK)

( * ) Notice: Subject to any disclaimer, the term of this patent is extended or adjusted under 35 U.S.C. 154(b) by 670 days.

(21) Appl. No.: 10/532,684

(22) PCT Filed: Nov. 24, 2003

(86) PCT No.: PCT/DK03/00802

§ 371 (c)(1),
(2), (4) Date: Apr. 26, 2005

(87) PCT Pub. No.: WO2004/048786

PCT Pub. Date: Jun. 10, 2004

(65) Prior Publication Data

US 2006/0073037 A1 Apr. 6, 2006

(30) Foreign Application Priority Data

Nov. 25, 2002 (DK) ..... 2002 01820

(51) Int. Cl.
*F04B 17/00* (2006.01)
*F04B 35/00* (2006.01)

(52) U.S. Cl. ..... 417/225; 60/579

(58) Field of Classification Search ..... 417/225, 417/400, 403, 404; 60/579
See application file for complete search history.

(56) References Cited

U.S. PATENT DOCUMENTS 2,991,130 A 7/1961 Sampietro
3,059,433 A * 10/1962 Hirsch ..... 60/565
3,737,254 A * 6/1973 Swatty ..... 417/403
4,126,996 A * 11/1978 Leiber ..... 60/547.1
4,271,671 A * 6/1981 Smeets ..... 60/578
4,348,161 A * 9/1982 Shibata ..... 417/403
4,523,895 A * 6/1985 Silva ..... 417/225
4,622,992 A * 11/1986 Sutherland ..... 137/504
5,009,777 A * 4/1991 Solomon ..... 210/134
5,092,744 A * 3/1992 Boers et al. ..... 417/397
5,170,691 A 12/1992 Baatrup
5,244,361 A * 9/1993 Solomon ..... 417/403
5,429,036 A * 7/1995 Latos ..... 91/181
5,865,029 A * 2/1999 Brieschke ..... 60/560

FOREIGN PATENT DOCUMENTS

DE 171121 6/1996
DK 10158181 5/2003

(Continued)

OTHER PUBLICATIONS

Isamu et al. "Booster," Sep. 17, 1998. Translation of Japanese Patent Application.*

*Primary Examiner*—Devon C Kramer
*Assistant Examiner*—Amene S Bayou
(74) *Attorney, Agent, or Firm*—James Creighton Wray; Meera P. Narasimhan

(57) ABSTRACT

The invention concerns a pressure amplifier that includes a low pressure inlet for supplying a medium at low pressure, a low pressure piston with a first operational area and at least one high pressure piston with a second operational area, the second area being smaller than the first area, and at least one high pressure outlet.

10 Claims, 5 Drawing Sheets

FOREIGN PATENT DOCUMENTS

| | | | |
|---|---|---|---|
| JP | 2000-087906 | * | 9/1998 |
| JP | 2000 087906 | * | 9/1998 |
| JP | 200087906 | | 3/2000 |
| JP | 200159501 | | 3/2001 |
| WO | 8607118 | | 5/1986 |

* cited by examiner

AMPLIFIER ASSEMBLY

This application claims the benefit of Danish Application No. PA 2002 01820 filed Nov. 25, 2002 and PCT/DK2003/000802 filed Nov. 24, 2005, which are hereby incorporated by reference in their entirety.

BACKGROUND OF THE INVENTION

The present invention concerns a pressure amplifier, including a low pressure inlet for supplying medium at low pressure, a low pressure piston with a first operational area and at least one high pressure piston with a second operational area, the second area being smaller than the first area, and at least one high pressure outlet.

This type of pressure amplifier is particularly used in hydraulic circuits, where the hydraulic pump integrated in the system cannot yield sufficiently high pressure for all applications. For a part of the hydraulic circuit it is not desirable either to operate with a hydraulic medium under such high pressure, since this make demands on the design of the hydraulic lines, joints between lines and the elements such as joints, valves, check valves etc., which do not necessarily need to be dimensioned for high pressure. Thus, a cost factor is also involved for making so low pressure in so large part of the hydraulic circuit as possible, and by inserting pressure amplifiers providing a high pressure where necessary.

In connection with the present invention, the terms low pressure and high pressure are used. As the principles underlying the invention are equally applicable at different pressures, low and high pressure, respectively, are only to be understood so that the two media have different (or same) pressure.

Furthermore, within the technical field it is commonly known how check valves are functioning, as well as the provision of return ducts, medium reservoirs, and the like, to the required extent are regarded as a matter of course for the skilled in the art. To the extent they are integrated in the apparatus and the system, respectively, and are not used directly in connection with the basically new and inventive principle of the invention, these are omitted to wide extent for the sake of clarity.

The medium that drives or is set under pressure and which is used in connection with the present invention is often hydraulic oil, but may be any other kind of liquid, including particularly water or a gas which is found suitable for use in this type of systems. Furthermore, the system and the pressure amplifier may be used by gases, including particularly air, as the pressure amplifier and the system in its structure are configured so that the possible compressibility of the gases does not have any influence on the function of the pressure amplifier.

Pressure amplifiers of the kind mentioned above are particularly used in hydraulic circuits, including particularly in cranes, trenchers, excavators, forklift trucks or corresponding machines, where great force is to be applied for lifting or moving material. For the operator of these machines, it is very desirable to dose the force to the work tools as accurately as possible. Another important aspect is to utilise the applied energy the most possible, i.e. to design a pressure amplifier and a pressure amplifier system with a minimal loss of pressure.

In a known pressure amplifier, as e.g. described in WO 8607118, is known a double acting pressure amplifier in which a central double-acting piston device provided within the pressure amplifier cylinder displaces a pre-selector that acts as a kind of servomechanism for a changeover valve, whereby liquid is continually allowed at low pressure by pushing on the low pressure pistons, so that the latter actuate a high pressure piston which via a rod transmits the high pressure to a possible actuator. The pre-selector is following the movement of the low pressure pistons slidingly, after which the valve opening is continually changed, so that at the middle of the stroke of the piston there will be fully open for the valve, whereby the opening, concurrently with the low pressure piston reaching the end of its stroke, will close more and more and thereby throttle down the intake of low pressure medium. Besides, there is provided a large number of springs, unions, and liquid ducts in and around the cylinder jacket, which otherwise co-operate with a number of sealing rings and screwed in shafts for providing low pressure liquid on the correct side of the low pressure pistons, so that these will be actuated for pressing the high pressure piston forwards for providing higher pressure.

In general, for this type of pressure amplifiers it applies that it is the effective operational area of the low pressure piston relative to the effective area of the high pressure piston that indicate the actual pressure amplification factor. For incompressible media, in theory the pressure amplification factor is directly proportional with the ratio between the two above mentioned areas. Actually, by a pressure amplifier as specified in WO 8607118 there will occur a relatively great energy loss in connection with supply of low pressure oil, as the oil is used for controlling the changeover valve, whereby losses arise in supply and relief ducts, as well as the shifting of the valve causes a pressing back and/or consumption of oil, whereby in practice a very substantial energy loss arises.

It is thus the purpose of the invention to provide a liquid or gas driven pressure amplifier that utilises all of the incoming energy for work energy.

Besides, it is a purpose to provide a pressure amplifier that does not have space demanding differential areas, whereby the entire operational area on the side operating at any time is utilised 100%, so that the energy from the drive medium is deposited as kinetic energy when moving the main piston. The other side of the main piston is simultaneously connected to a tank so that no overpressure is to be overcome.

Furthermore, the invention has the purpose of providing a changeover valve which becomes activated by the movement of the main piston in such a way that a possible flow loss and thereby pressure loss is thereby minimised. In the same connection, it is important to control the changeover valve under all conditions so that the pressure amplifier, at low as well as high operational frequencies and by rapid pressure changes will function with great certainty. This is particularly interesting where the pressure amplifier is to operate at a high rate, i.e. many directional changes per minute.

It is thus a further purpose of the invention to provide a pressure amplifier that via its construction becomes cheaper and more compact than the hitherto known amplifiers, simultaneously with being provided greater power and greater reliability.

SUMMARY OF THE INVENTION

The invention provides for these problems by means of pressure amplifier which is peculiar in that a low pressure area communicates with a operational chamber, which is limited by a low pressure piston and a surrounding cylinder; where at least one high pressure piston is provided interacting with the low pressure piston, and that the high pressure piston is coaxially arranged in a high pressure cylinder relative to the low pressure piston; that a changeover valve is coaxially arranged in the cylinder, and that in connection with the valve and for interaction with it there is arranged at least one spring coaxially around an impulse rod; that the spring is arranged to be compressed so that a spring loaded locking mechanism is instantly released, the locking mechanism being built up of one or more springs that press a locking member against a corresponding lock abutment formed in the valve, so that the valve shifts and opens for medium supply to the operational chamber, whereby the low pressure piston, via contact with the high pressure piston, is moving the latter towards the high pressure outlet due to supply of medium to the operational chamber, whereby this tightens a spring which in the end position releases the locking mechanism whereby the valve shifts and the low pressure medium, via the low pressure connection via check valve, presses the high and low pressure pistons in opposite direction, whereby the displaced medium is conducted back to the tank.

By this construction, where the changeover valve is in one of two positions during largely the whole process with pressing the low pressure oil and thereby the low pressure piston forward and back, respectively, succeeded by a instantaneous change-over due to the locking mechanism, it is achieved that the pressure medium intake is not throttled down. When the flow ducts, i.e. the ducts of the pressure medium, are held fully open during the entire movement of the pistons, however except the milliseconds when the spring-loaded changeover valve jumps from one position to another, it is achieved that the pressure loss in the pressure amplifier becomes negligible. Furthermore, it is achieved that by high cyclic change-over speeds, i.e. high operational frequencies, the operation becomes more accurate, as the function of the changeover valve can be compared with an on-off situation so that it is not an area where less pressure medium is supplied gradually, but there is full pressure medium or no pressure medium.

At the same time, the construction is substantially simplified compared with prior art, as all moving parts are concentrically arranged about a centre line. This implies a considerable reduction in the machining step of cylinders and pistons, as well as the number of parts can be reduced substantially.

The different pistons, valves, springs and rods are held in position by means of locking rings, as e.g. Seeger rings, O-rings, bayonet coupling, or similar.

By furthermore choosing the springs so that compression, meaning the energy accumulated in the spring, corresponds to the releasing pressure of the locking mechanism and thereby the springs forming part of the spring constants of the locking mechanism in such a way that the force in the locking mechanism is surmounted at the maximum compression of the spring arranged coaxially around the impulse axis, the instantaneous, very sudden change-over from movement in one direction of the low pressure piston to movement in the opposite direction of the low pressure piston is achieved.

In a further, preferred embodiment of the invention, the locking arrangement has been built up in at at least one boring provided radially in the low pressure cylinder, and that in the boring a locking element has been provided, e.g. in the shape of a ball, the ball interacting with a spring so that the ball is pressed down into one of two recesses with dimensions corresponding to the part of the ball provided in the cylindric surface of the valve. Instead of a ball, other elements may be used, e.g. a cylindric pin with a rounded top, or a wedge-shaped element with corresponding profile provided in the surface of the valve.

It is a preferred embodiment of the locking mechanism, which is simply established by two indentations being arranged at the outer side of the valve body, so that the locking element, e.g. the ball or one of the corresponding elements described above, are pressed down into the first recess by means of the spring force from the spring of the locking mechanism. The recesses have partially circular cross-sections, where the diameter corresponds to the ball diameter or is designed with a cross-section corresponding to the shape of the locking element. When subsequently the low pressure piston moves forward under influence of the medium pressure, the spring around the impulse axis will be compressed until a spring force is achieved, the spring force being necessary to overcome the lodging of the ball in the valve body, after which this is pressed up against the springs in the locking mechanism, and the valve suddenly changes its setting. This instantaneous, mechanical change-over from one situation without using drive medium for the second situation implies that there is substantially less flow loss in the pressure amplifier. By the known pressure amplifiers, a flow loss of 30-50% is expected, where by experiments with pressure amplifiers according to the present invention it has appeared that the flow loss becomes substantially less, namely about 8%.

In a further, preferred embodiment of the pressure amplifier, the locking arrangement is built up in an annular, flat groove provided at the inner side of the low pressure cylinder, so that at least two U-shaped locking blocks are arranged in the groove, the locking blocks being chamfered at the ends, that a number of radially oriented borings have been provided, corresponding to the number of locking members, and that in each boring there is arranged a spring pressing the blocks towards the centre line of the cylinder so that the chamfered ends of the blocks co-operate to hold a locking element arranged in the valve in one of two positions on respective chamfered sides of the blocks, whereby a functionally reliable locking arrangement is also achieved.

By taking advantage of the principles of production used for the inner machining of the surfaces of the cylinders, there may advantageously be arranged an extra groove in connection with the locking mechanism. The blocks will then have shape as two U-shaped locking blocks where at the free ends chamfered edges have been provided. The chamfered edges are used for abutment against a locking element, e.g. in the form of a rod/pin provided in the body of the changeover valve. In the same way as described above in connection with the ball lock, due to the displacement of the low pressure piston a spring stress will be built up in the spring arranged coaxially about the impulse rod, this force pressing the rod against the chamfered sides in the locking blocks. When the force attains a certain size, the rod will be pressed through the chamfering by overcoming the spring force in springs arranged in the locking mechanism. At the moment the spring force in the impulse rod reaches that level, the change-over in the valve will occur instantaneously, and the changeover valve will be held in the new setting until the position again reaches a size by which the pin/rod may press the two chamfered sides on respective locking blocks away from each other, and will again instantaneously change their position.

In a further, preferred embodiment, the pressure amplifier is double-acting, so that the impulse rod interacts with two high pressure pistons arranged on opposite sides of the operational chamber, and furthermore there are provided two high pressure outlets.

Since the changeover valve is arranged concentrically around the impulse rod inside the cylinder, in this embodiment it is possible to let the impulse rod continue linearly through the changeover valve, and here be in contact with yet a high pressure piston. A further low pressure connection is provided axially in parallel with the centre line in the lower pressure cylinder, whereby by changing the direction of supply when the changeover valve switches from one position to another position, low pressure medium will be supplied at the opposite side of the main piston whereby this will imply high pressure to be formed at the opposite end of the pressure amplifier.

In a further, preferred embodiment of the invention, high pressure piston and impulse rod, respectively, are loosely connected to the low pressure piston, e.g. by means of flanges provided at one end of the high pressure piston and the impulse rod, respectively, which flanges largely fit a corresponding, partially closed recess provided in the end faces of the low pressure piston, so that the flanges of the impulse rod are loosely held by means of locking rings.

In that connection, by loosely connected is meant that such a connection is provided between the low pressure piston and the high pressure piston and the impulse rod, respectively, that it is possible for the elements to rotate, displace or in other ways perform turning/displacement individually, without the coherent member necessarily being applied a load.

This is very important as the tolerances with which the high pressure cylinder and the main cylinder are joined thereby have less significance, as well as possible wear over time will have less influence on the operation of the pressure amplifier.

When it is possible to reduce requirements to the constituent elements, this implies a saving in the production step but also an increased expectancy of service life, as the wear is reduced by the movable parts due to their ability of accommodating tolerances that may arise in the system due to heat action, wear, inaccuracies in the assembling step etc. Besides, the assembly of the pressure amplifier also enables relatively uncomplicated disassembling of the pressure amplifier in connection with service or replacement of individual parts. This is also associated with low pressure piston and changeover valve operating in the same boring with a uniform cross-section. The individual elements are fitted by means of e.g. locking rings, so that the elements (low pressure piston, impulse rod, changeover valve, spring etc.) by removing the locking rings may be taken out of the cylinder, be inspected and to the required extent be overhauled or replaced, after which the pressure amplifier may be assembled again without any problems.

The above mentioned advantages are even more expressed in a further, preferred embodiment of the invention, in which high and low pressure pistons, high and low pressure cylinders, check valves, high and low pressure connections with associated springs and locking mechanisms are arranged coaxially and symmetrically around a common centre axis.

In an embodiment of the pressure amplifier according to the invention, the pressure amplifier housing consists of three assembled cylindric parts, in which internally a cylinder is provided, in which is arranged a changeover valve and lower pressure piston and impulse rod, and in a second cylinder, in immediate connection with the first cylinder, is arranged a high pressure piston with lesser diameter. In the high pressure piston end is installed a high pressure port via a check valve, and in the low pressure end there is arranged two gates as well, one for supplying low pressure medium and one for medium returning to the reservoir.

Traditionally, when this type of typical hydraulically powered cylinders, they being pressure amplifiers or other elements, are made, ducts are often to be provided perpendicularly to the centre line of the item. This is normally done by radially drilling a hole from the outer side of the cylinder and into and through the internal cylinder cavity of the cylinder. Then a plug is fitted in the surface with the consequent risk of leakages. This method for providing ducts perpendicularly to the centre line of a cylinder has several advantages as long as the medium conducted in the duct does not have a particularly high pressure. The plugs are normally usable up to a pressure about 500 bar, after which the risk of failure, e.g. in the form of leaks, rises sharply. In connection with development of the present pressure amplifier, where operation may take place with considerably higher pressure, this solution is thus not applicable. The connection between two parallel medium ducts in the cylinder is therefore provided with a so-called T-cutter or another suitable tool for providing a radial milled recess, forming connection between the two parallel axial ducts.

The radial recess thus provides a number of advantages, inter alia the radial drilling with subsequent plugging is avoided, which, besides saving work procedures in connection with drilling and subsequent plugging, also increases safety for the operation of the pressure amplifier at high pressures, as the risk of a failure in a possible plug is not present. Besides, the effective flow area becomes substantially larger with a radial milled recess compared with the traditional drilling, whereby the invention is providing a considerably lesser pressure loss again compared with traditional constructions. Besides increasing the operative reliability and reducing the pressure loss, the increased duct size also enables a higher rate of operation and thereby a better utilisation of the entire pressure amplifier.

By the construction of the pressure amplifier according to the invention as described above, the number of joints, plugs and other weak spots in the pressure cylinder itself are avoided and minimised, why it is the other components in system that determine the dimensions for how high pressure to be operated with. The pressure amplifier is thus not limited to the recommended maximum pressures in the system. Standard elements used in high pressure hydraulic systems, may typically operate up to 800-900 bar, but the pressure amplifier according to the invention has shown that it may work reliably and safely at substantially higher pressures.

In a further, preferred embodiment, externally of the valve there is provided an annular turning with a diameter less than the outer diameter of the valve and a length in longitudinal direction of the pressure amplifier, the length being substantially less than the length of the valve, and that at least two holes are provided in the valve radially from the interior of the valve to the exterior of the valve, and that one hole is provided coinciding with the annular turning, and that the other hole is provided outside the annular turning.

By this construction is achieved a hydrodynamic balancing, as it appears that by the pulsating pressure differences arising during operation with the pressure amplifier, pressures can arise inside the valve being so great that it will expand and thereby become squeezed against the cylinder wall. Thereby it is not possible for the springs to move the valve, why it also becomes impossible to achieve the instant release of the locking function. This is mainly caused by the fact that due to the high operating speed it is not possible to equalise the pressure via the fit between valve and cylinder. On the contrary, by providing an annular turning and at least two holes, there will thus be an immediate connection between the pressure prevailing at any time at the operating side to the outer side/interspace between the cylinder, so that it will immediately be possible to equalise the pressure at the outer side and the inner side, respectively, of the valve, whereby the valve will not be jammed against the cylinder wall and may continually function according to the purpose.

In a still preferred embodiment of the invention, for facilitating the assembling and disassembling of the connection between the impulse rod, which is passed through the changeover valve, and the low pressure piston, a bayonet coupling has been provided. After inserting the impulse rod in the low pressure piston, the rod is turned 90° and secured with a locking bolt. The assembly is made with a sufficient radial clearance in order that the elements can operate unhinderedly.

The invention will now be explained in more detail with reference to the accompanying drawing, wherein:

DETAILED DESCRIPTION OF THE PREFERRED EMBODIMENTS

Figure 1:
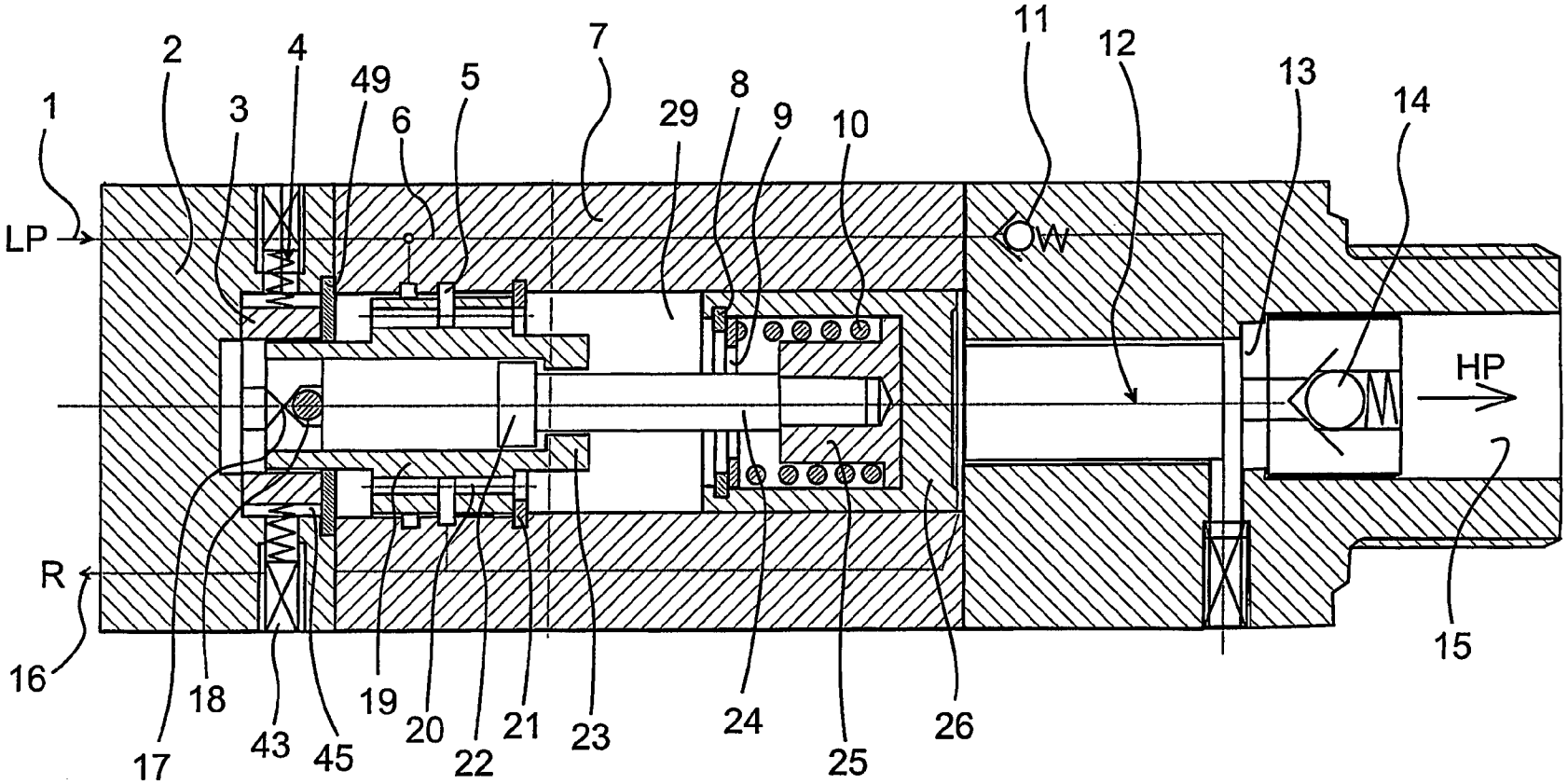
FIG. 1 illustrates in principle the structure of a pressure amplifier.

In FIG. 1 is illustrated the structure of a single-acting pressure amplifier according to the invention in principle. The pressure amplifier is built up around a operational chamber 29, which is delimited by a cylinder 7. Within the operational chamber there is provided a low pressure piston 26 which is connected to a changeover valve 19 with an impulse rod 24. A high pressure piston 12 is provided in connection with the low pressure piston. Besides, a low pressure gate 1 is arranged at one end of the pressure amplifier, the low pressure gate being controlled by the valve 19 is communicating via axial ducts 6 with the operational chamber as well as a return line 16 from the operational chamber conducts the pressure medium controlled by the valve back to a reservoir.

At the opposite end is arranged a high pressure outlet 15, which via a check valve 14 is in one-way medium communication with the high pressure cylinder 13.

In FIG. 1, the low pressure piston 26 has been pressed forward to its foremost position by means of the supply of low pressure medium through the low pressure gate 1 and the operational chamber 29. Hereby, the high pressure piston 12 is also pressed forward to the end in the high pressure cylinder 13. The low pressure inlet 1 will now bring low pressure medium via the check valve 11 to the front side of the high pressure piston 12.

As long as the pressure demand in the high pressure outlet 15 is less than the low pressure minus the opening pressure in the check valve 11, 14, the low pressure medium will flow directly to the place of consumption simultaneously with the low pressure medium via the check valve 11 pressing the high pressure piston 12 as well as the low pressure medium 26 to the left.

This may be effected since the changeover valve 19 in this situation has connected the operational chamber 29 to the tank via the return duct 16, and the opposite end of the main piston is in permanent connection with tank via return duct 16.

At the return movement, the axially displacing disc 9 provided in the low pressure piston loaded with the spring body 10 will hit the projecting end 23 on the changeover valve 19 shortly before the finish of the return movement—(the situation is not shown in the Figure).

By continuous supply of low pressure medium via the check valve 11 to the front side of the high pressure piston 12, this and thereby simultaneously the continued return movement of the low pressure piston will pre-stress the spring body 10 until a force is attained which is capable of overcoming the locking force acting with the spring body 4 in the locking mechanism, pressing the pin 18 past the chamfered sides 17 on the locking items 3, the locking items being provided in a flat, round groove 45 in the cylinder.

Spring body 4 is arranged in radially oriented borings 43.

The changeover valve 19 will hereby move from the position shown in FIG. 1 to a position where the pin 18 is secured at the opposite side of the chamfered ends on the locking items 3.

In this position, access is created from the low pressure gate 1 via the supply duct 6 axially disposed in the cylinder body 7 to the opening 20 in the changeover valve 19. Low pressure medium may hereby flow into the operational chamber 29 and actuate the low pressure piston 26 to forward movement, whereby the high pressure 12 is also moved forward. The low pressure medium in the high pressure cylinder 13 will then be subjected to pressure, whereby the check valve 11 will close simultaneously with the check valve 14 will open and allow high pressure medium to flow out through the high pressure gate 15.

As the low pressure piston is pressed forward due to the continued supply of low pressure medium through the low pressure gate 1 and the opening 20 in the changeover valve 19 into the operational chamber 29, the head 22 on the impulse rod 24 will be retarded in its free movement by contact with the recess inside the changeover valve 19. At the continued, forward movement of the low pressure piston, the nut 25 screwed on the opposite end of the impulse rod 24 will provide a pre-stressing of the spring 10.

As long as the impulse rod 24 may move freely in the stroke S, no pre-stressing of the spring 10 will occur. The stroke S is so adapted to the full length of the cylinder that before the low pressure piston reaches its end position, as shown in FIG. 1, a certain compression of the spring 10 will have occurred. By slow and intermediate operation frequency, this pre-stressing of the spring disposed coaxially around the impulse rod 24 and inside the low pressure piston 26 in the shown example, will be sufficiently great that it will overcome the holding of the changeover valve, i.e. the grip of the locking mechanism around the pin 18, why this will be instantly released. At higher operation frequencies, the inertia in the changeover valve 19 will provide that the spring force in the spring 10 does not have sufficient force to overcome the locking mechanism of the changeover valve. For this reason, mechanical contact has been arranged between the nut 25, the disc 9 and the shoulder (the projecting end) 23 on the changeover valve 19, respectively, and in opposite direction between the head 22 on the impulse rod 24, the changeover valve 19, the nut 25, the disc 9 and locking ring 8.

This mechanical contact will bring the changeover valve to its middle position, after which the spring 10, which is now tensioned the most, will provide for the rest of the movement.

Figure 2:
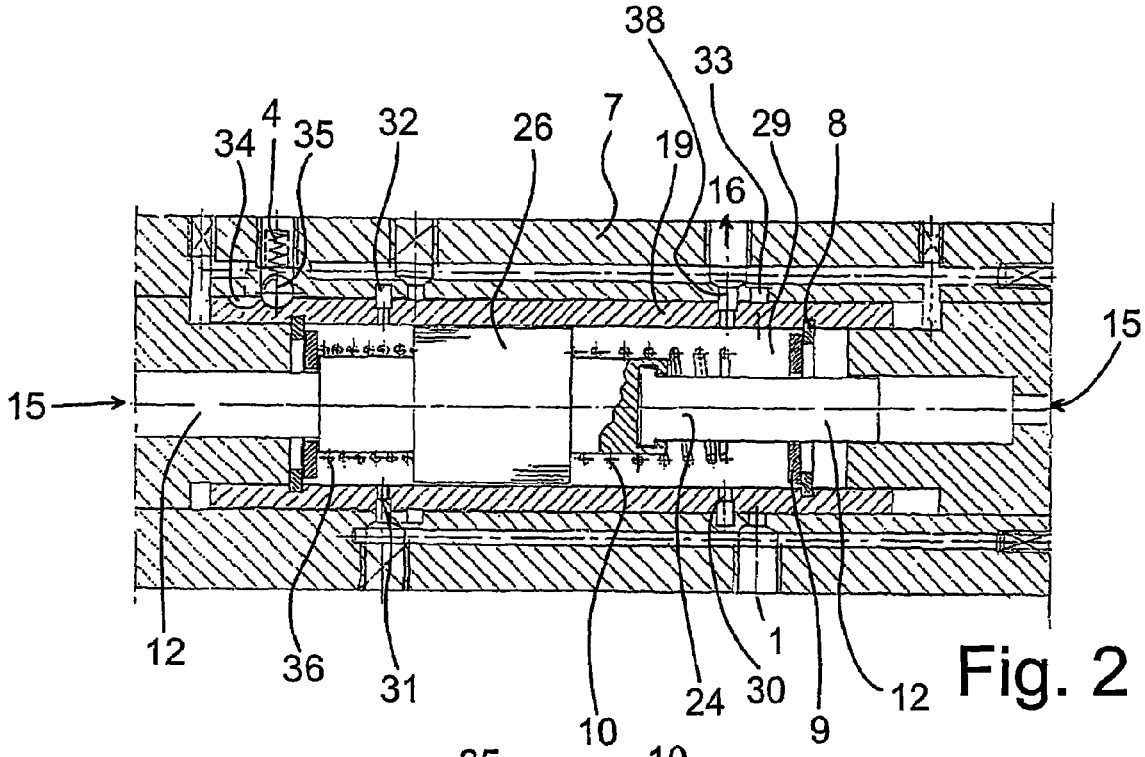
FIG. 2 illustrates a double-acting pressure amplifier.
Figure 3:
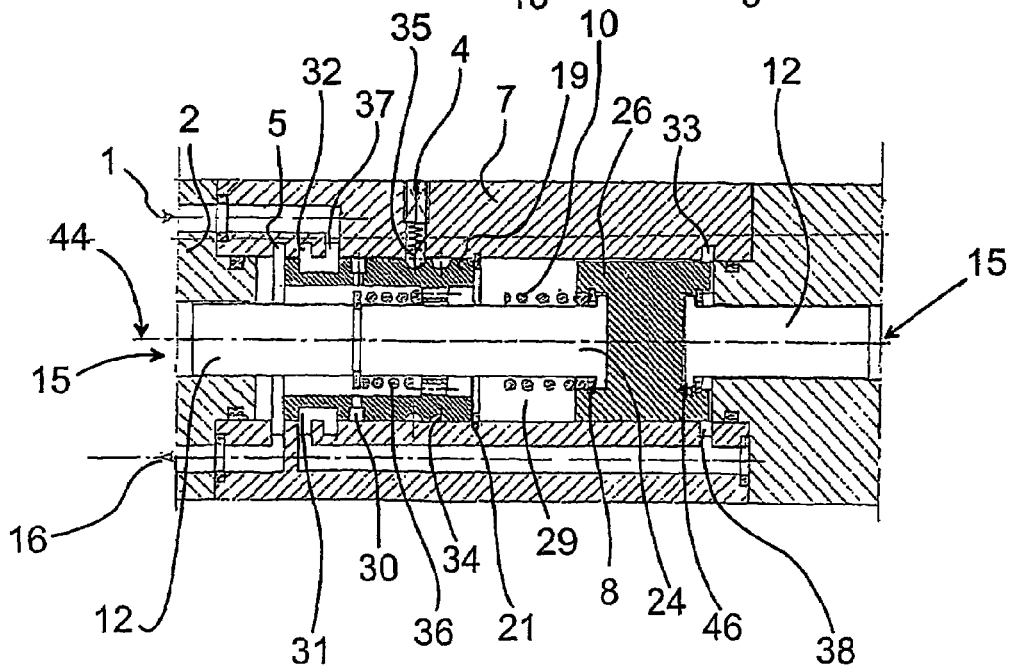
FIG. 3 illustrates a double-acting pressure amplifier.

In FIGS. 2 and 3, the principles in a double acting pressure amplifier is illustrated in two different forms, these pressure amplifiers operating in principle according to the same principles as described above with reference to a single-acting pressure amplifier. Reference numerals are the same in all Figures.

With reference to FIG. 2, an embodiment of the invention will be explained. The pressure amplifier illustrated in FIG. 3 is largely analogous to that shown in FIG. 2. By supplying a liquid or gaseous driving medium at a certain pressure to the gate 1 in the outer housing, this will, via the axial duct, be conducted to the two annular grooves 32, 33 at the inner side of the cylinder 7. Depending on the changeover valve, in this embodiment in the shape of the position of the internal cylinder bushing 19, the drive medium will flow on into one of the annular grooves 30, 31 on the outer side of the changeover valve and from here on through a number of holes in the bottom of the these into the interior 29 of the cylinder and actuate the main piston 26 to be moved in one or the other direction.

In the same way, the displaced medium on the opposite side of the piston can flow out through the holes in the cylinder bushing, further on through the grooves 30, 31 to the grooves 37, 38 and through the axial duct in the housing 7 to the return duct 16.

The internal bushing 19 forming the cylinder itself, is axially displacing in the external housing 7. Hereby is achieved alternating connection for the driving medium on one or the other side of the main piston 26 and access for the flowing away of medium at the opposite side of the piston.

In order to avoid disturbing influence due to different pressure on the end faces of the cylinder bushing, both of these are relieved to the return connection 16.

In order to achieve a rapid and constant change of direction of this valve construction, two circular, annular grooves 34 have been made, or one or more axial grooves, or two or more transverse wedge-shaped grooves, at the outer side of the cylinder bushing 19. By means of a locking device, e.g. in the shape of one or more balls 35, wedges or pins with ball-shaped end wedges, or rollers loaded with a spring body, a rapid and secure valve shifting is achieved, when the locking force of this device is overcome. The two impulse springs 10, 36 are having such a spring characteristic that they just have reached a suitable pre-stressing for disengaging the above mentioned locking device 35 immediately before the end positions of the main piston. The pre-stressing of the spring body in the locking and positioning device 35 and the impulse springs 10, 36 will rapidly and precisely bring the changeover valve to the reverse function.

For achieving a sure valve shifting at high operating speed in accordance with the description of the invention as shown in FIG. 1, the low pressure piston 26 and valve 19 via disc 9 and locking ring 8 are coupled together.

This system provides a rapid and secure valve shift at high operating frequencies as well as by very slow, sneaking movements of the main piston. The latter is e.g. the case when using the actuator in connection with pressure amplifiers for liquid or gases.

By means of the two outlet pistons 12, the axial movements are transferred to the actual pump function.

The actuator shown on FIG. 3 functions in a corresponding way, but the displacing valve member is only provided inside the cylinder boring itself which is formed by the outer housing.

Figure 4:
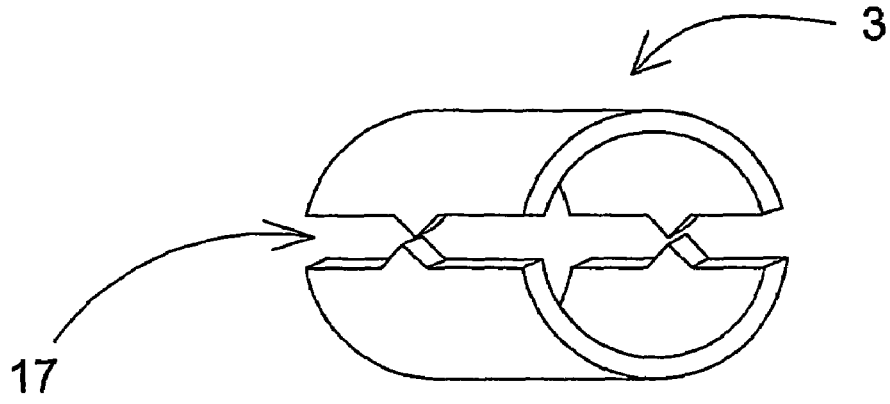
FIG. 4 illustrates a detail of lock blocks.

In FIG. 4, the locking items 3 used in FIG. 1 are shown in detail. The chamfered points 17 are arranged so that they are just making contact in the locked condition. Furthermore, the blocks 3 are spring loaded so that a considerable force is required to press the blocks 3 away from each other via the edges 17 whereby the instant shift of operating direction is produced.

Figure 5:
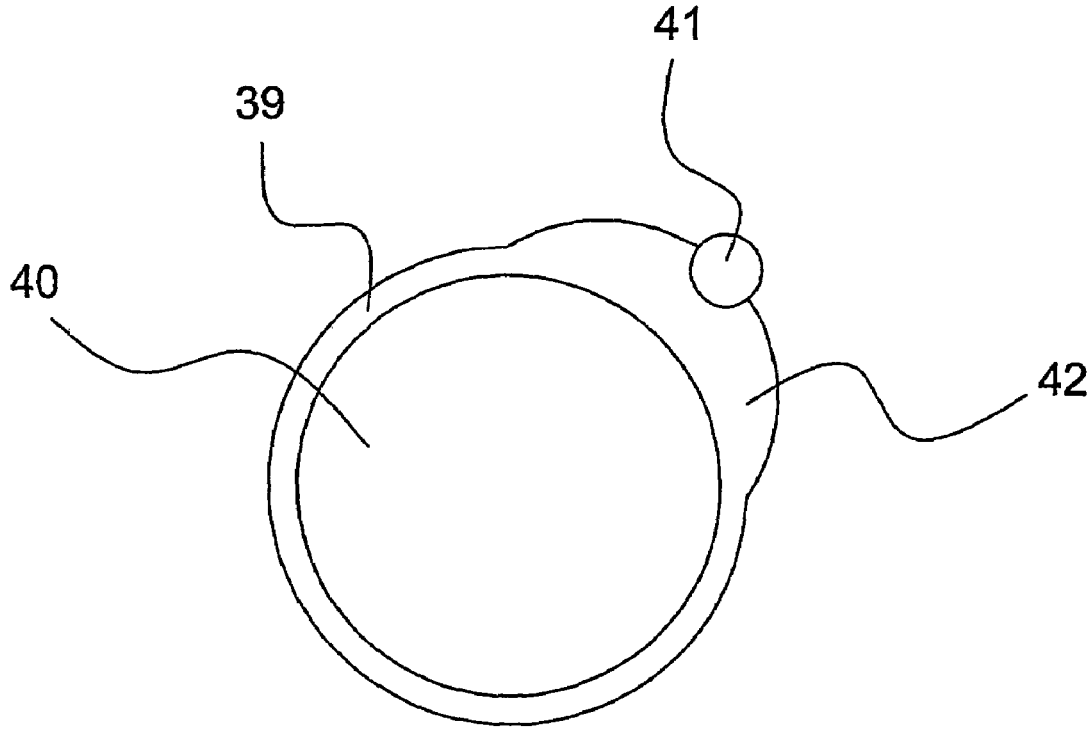
FIG. 5 illustrates a detail of a connecting duct.

In FIG. 5 is illustrated how the invention also provides a new and secure principle for providing connecting ducts perpendicularly to the centre line of the item.

The connection ducts serve to connect the axial ducts, e.g. ducts for supplying pressure medium to the operational chamber. Typically, these connecting ducts are made by boring radially to the centre line 44 from outside the item. The hole is then plugged, e.g. by screwing on a special plug. The invention, however, provides these connecting ducts by making a ring channel 39 around the valve boring 40. In the ring channel 39 is then made, e.g. with a T-cutter, a radial recess 42, whereby connection to a duct 42 is formed in parallel with the valve boring 40.

Figure 6:
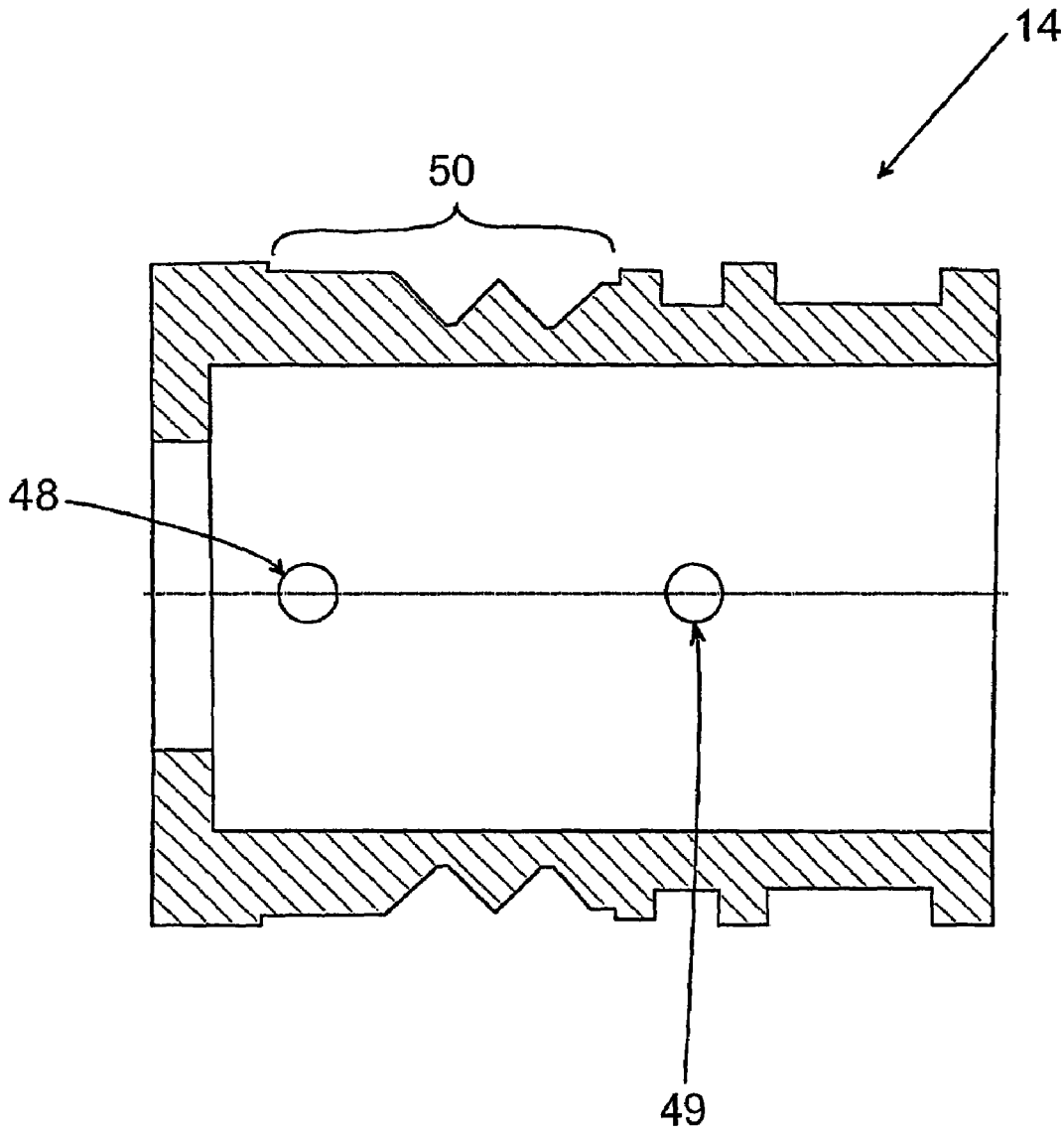
FIG. 6 illustrates an annular turning in the valve body.

In FIG. 6 is illustrated a further embodiment of the valve body 19 in which is provided a annular turning 48. Besides, two holes 46, 47 are provided, the holes connecting the inner side of the valve body 19 with the outer side of the valve body. One hole 46 is provided opposite to the annular turning, whereas the other hole 47 is provided outside the annular turning. Thereby it becomes possible instantly to compensate for pulsating pressure on one and the other sides, respectively, of the valve, so that the valve body 19 by very great or rapid changes in pressure due to the pulsating operative movement in the pressure amplifier is not jammed against the cylinder surrounding the valve 19. In this Figure, the cylinder is not depicted. By providing a annular turning 48 in the valve body 19 there is thus achieved a hydrodynamic balancing in the valve body, whereby this, even under extreme operating conditions, will operate reliably without risk of jamming in the cylinder.

Figure 7:
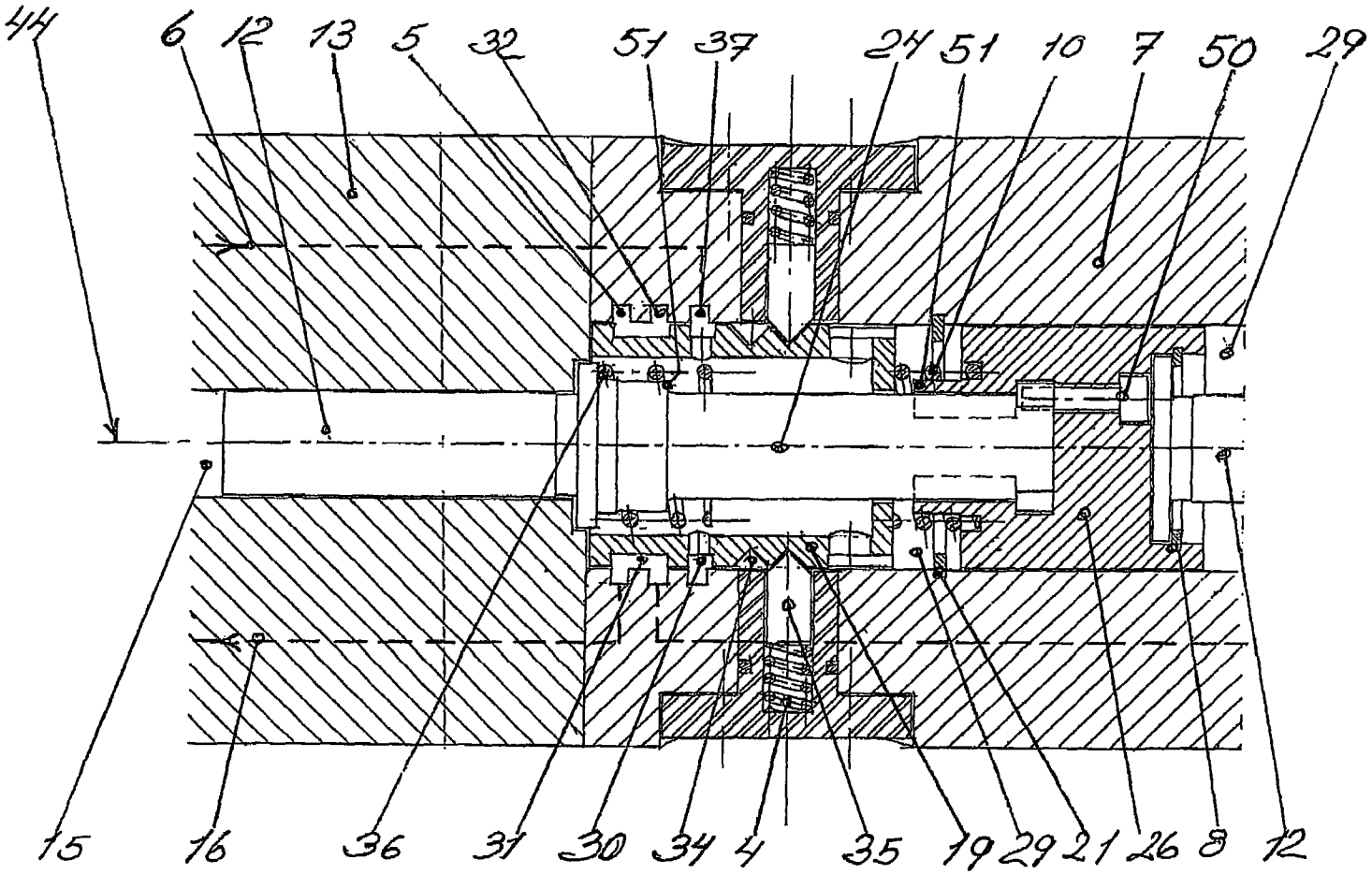
FIG. 7 illustrates a locking mechanism, valve assembly and spring stop.

FIG. 7 illustrates a further embodiment of the invention.

As distinct from the above mentioned embodiments, this example differs particularly on these points:

1) The locking mechanism

2) The assembly of the valve

3) Fixed stops 51 for springs 10, 36

In this embodiment, the locking mechanism is provided as an independent body which e.g. is screwed into the cylinder 7. With this is achieved that it becomes relatively simple to replace the spring element 4 and/or the ball/wedge locking device 35. This may be the case in connection with usual maintenance or in connection with a desired change in the pressure amplifier, e.g. by increasing the force (stronger spring) to be overcome before the valve shifts.

In this embodiment, assembly of the valve is performed by means of an oil tight bayonet socket. When the locking ring 21 is mounted, valve, impulse rod and low pressure piston are secured inside the cylinder 7. By using a bayonet socket, the impulse rod is pushed in, turned 90° and then locked/secured by means of the locking bolt 50.

The fixed stops 51 prevent too great compression/squeezing of the spring 10 and ensure correct rapid shift at high frequencies. Too great compression/squeezing may cause destruction of the spring, whereby the entire function of the apparatus may be destroyed.

The locking arrangement is, as described above, built up of springs 4 that actuate balls, wedges or other locking elements 35 for engaging and holding of the changeover valve 19. In FIGS. 6 and 7, the grooves 30, 31 in the changeover valve 19 are made as linear, transverse grooves 34. The corresponding locking elements 35 may advantageously be designed as wedges. With this embodiment is achieved a considerably better securing of the changeover valve 19, as the wedges 35 have a greater contact surface on the grooves 34 than the balls (see FIG. 2) have on the corresponding grooves 34.

The invention claimed is:

1. Pressure amplifier including a low pressure inlet for supplying a drive medium at low pressure, a low pressure piston with a first operational area and at least one high pressure piston with a second operational area, the second operational area being of same size or less than the first operational area, and at least one high pressure outlet, wherein a low pressure area (1) communicates with an operational chamber (29), which is limited by the low pressure piston (26) and a surrounding low pressure cylinder (7);

where the at least one high pressure piston (12) is provided interacting with the low pressure piston (26), and the at least one high pressure piston (12) is co-axially arranged in a high pressure cylinder (13) relative to the low pressure piston; wherein a changeover valve (19) is coaxially arranged in the low pressure cylinder (7), and in connection with the changeover valve (19) there is arranged at least one impulse spring (10,36) coaxially around an impulse rod (24); wherein the at least one impulse spring (10,36) is arranged to be compressed at the movement of the low pressure piston so that at least one spring loaded locking mechanism (3, 35) is instantly released, the locking mechanism being built up of one or more springs (4) that press a locking member (3, 35) against a corresponding lock abutment formed in the changeover valve (19), so that the changeover valve shifts and opens for the drive medium supply to the operational chamber while simultaneously the low pressure piston, via contact with the high pressure piston, is moving the high pressure piston towards the high pressure outlet (15), whereby the impulse rod (24) via the at least one impulse spring (10,36) and mechanical stops (8,9,22,23,25) in an end position of the low pressure piston releases the locking mechanism (3, 35) whereby the changeover valve shifts and the drive medium, via a low pressure connection (6) via a check valve (11), presses the high and low pressure pistons back.

2. Pressure amplifier according to claim 1, characterised in that the locking mechanism is built up in at least one boring provided radially in the low pressure cylinder (7), and that in the boring a ball or a wedge (35) has been provided, the ball or wedge interacting with a spring (4) so that the ball or wedge (35) are pressed down into one of two recesses (34) with same dimensions as the part of the ball or wedge (35) provided in a cylindrical surface of the changeover valve (19).

3. Pressure amplifier according to claim 1, characterised in that the locking mechanism is built up in an annular, flat, round groove (45) provided at the inner side of the low pressure cylinder (7), so that at least two U-shaped locking members (3) are arranged in the groove, the locking members (3) being chamfered at the ends (17), that a number of radially oriented borings (43) have been provided, corresponding to the number of locking members (3), and that in each boring (43) there is arranged a spring (4) pressing the locking members (3) towards the centre line (44) of the cylinder so that the chamfered ends (17) of the locking members co-operate hold a locking element (18) arranged in the valve in one of two positions on respective chamfered sides (17) of the locking members (3).

4. Pressure amplifier according to claim 3, characterised in that the pressure amplifier is double-acting so that the impulse rod (24) is interacting with two high pressure pistons (12) arranged at opposite sides of the operational chamber (29), and that furthermore two high pressure outlets (15) are provided.

5. Pressure amplifier according to claim 1, characterised in that the high pressure piston (12) and impulse rod (24), respectively, are loosely connected to the low pressure piston (26) by means of flanges that are provided at one end of the high pressure piston and the impulse rod, respectively, the flanges (46) largely fitting in corresponding cavities provided in the end faces of the low pressure piston so that the flanges are loosely held by means of locking rings (8).

6. Pressure amplifier according to claim 1, characterised in that the high and low pressure pistons, the high and low pressure cylinders, the check valve and one or more additional check valves, the low pressure connection and a high pressure connection with associated springs and locking mechanisms are arranged coaxially and symmetrically around a common centre line (44).

7. Pressure amplifier according to claim 6, at least one boring (40) and parallel axial connections (6,16,40,41) and annular channels (30,31,32,33,34,39) with interconnection established by radial milling from inside the at least one boring.

8. Pressure amplifier according to claim 1, characterised in that one or two of the pistons are used for driving a pump fitted thereon for pumping another medium than the drive medium, or for driving other oscillating apparatuses.

9. Pressure amplifier according to claim 1, characterised in that externally of the changeover valve, an annular turning is provided with a diameter less than the outer diameter of the changeover valve and a length in longitudinal direction of the pressure amplifier, the length being substantially less than the length of the changeover valve, and that at least two holes are provided in the changeover valve radially from the interior of the changeover valve to the outside of the changeover valve, and that one hole is provided coinciding with the annular turning, and that the other hole is provided outside the annular turning.

10. Pressure amplifier according to claim 4, wherein the two high pressure outlets are brought together to a common outlet.

* * * * *

UNITED STATES PATENT AND TRADEMARK OFFICE

CERTIFICATE OF CORRECTION

PATENT NO. : 7,597,545 B2
APPLICATION NO. : 10/532684
DATED : October 6, 2009
INVENTOR(S) : Harry Emil Pedersen et al.

It is certified that error appears in the above-identified patent and that said Letters Patent is hereby corrected as shown below:

In the Claims:

Column 12, line 22 (claim 7, line 1):

Before "at least one" insert --further comprising--.

Signed and Sealed this

Seventeenth Day of November, 2009

David J. Kappos

David J. Kappos
*Director of the United States Patent and Trademark Office*